US005307793A

United States Patent [19]

Sinclair et al.

[11] Patent Number: 5,307,793

[45] Date of Patent: May 3, 1994

[54] MICROPHONE SIGNAL ATTENUATING APPARATUS FOR OXYGEN MASKS

[75] Inventors: Gary A. Sinclair, Fountain Valley; Charles L. Vice, Orange, both of Calif.; Michael Brumley, Shawnee; Tom McDonald, Overland Park, both of Kans.

[73] Assignee: Puritan-Bennett Corporation, Overland Park, Kans.

[21] Appl. No.: 906,234

[22] Filed: Jun. 29, 1992

[51] Int. Cl.[5] ..... A62B 18/08

[52] U.S. Cl. ..... 128/201.19; 128/205.25

[58] Field of Search ..... 128/200.29, 201.19, 128/205.25

[56] References Cited

U.S. PATENT DOCUMENTS 3,347,229 10/1967 Heitman ..... 128/201.19

3,415,245 12/1968 Yamamato et al. ..... 128/201.19

3,850,168 11/1974 Ferguson et al. ..... 128/201.19

4,799,263 1/1989 Banziger et al. ..... 128/201.19

*Primary Examiner*—Edgar S. Burr

*Assistant Examiner*—Aaron J. Lewis

*Attorney, Agent, or Firm*—Hovey Williams Timmons & Collins

[57] ABSTRACT

The microphone of a breathing mask such as an aircraft flight crew oxygen mask is disabled during inhalation to prevent transmission of air flow sounds. In the preferred embodiments, selected mechanisms determine when breathable gas has been delivered to the mask and in response, disable the microphone by disconnecting it during this time. In another embodiment, a cover shifts into position over the microphone to prevent or reduce reception of sounds thereby during delivery of gas to the mask.

8 Claims, 5 Drawing Sheets

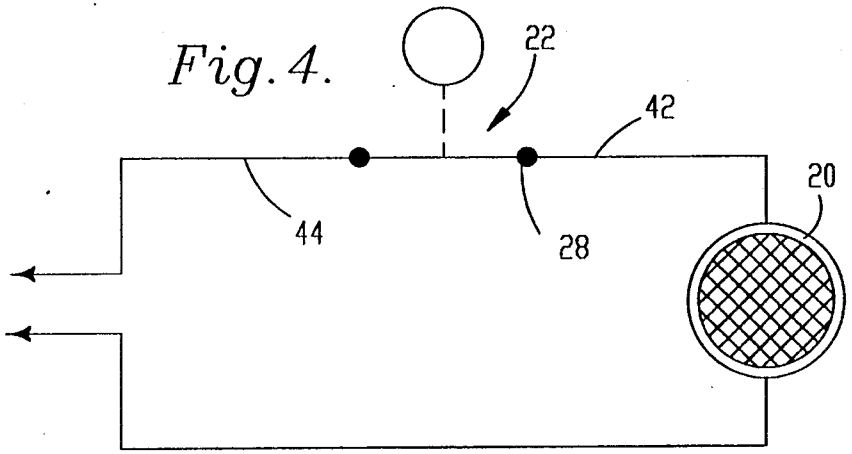
Fig. 4.
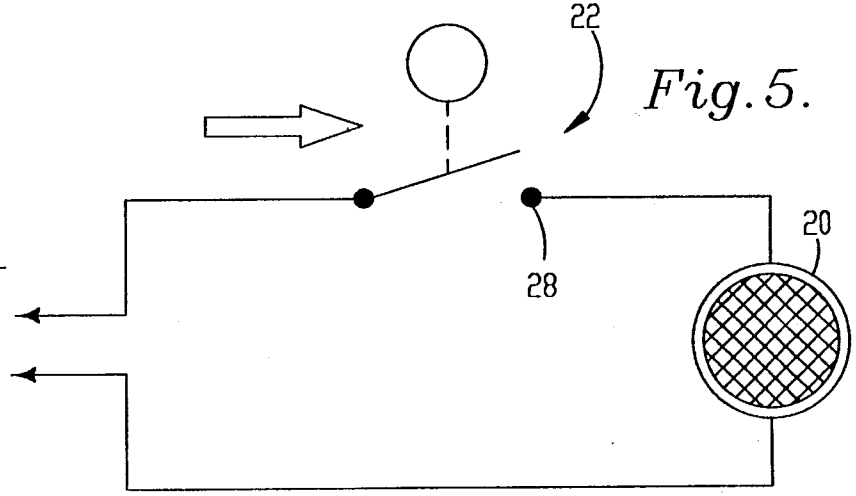
Fig. 5.
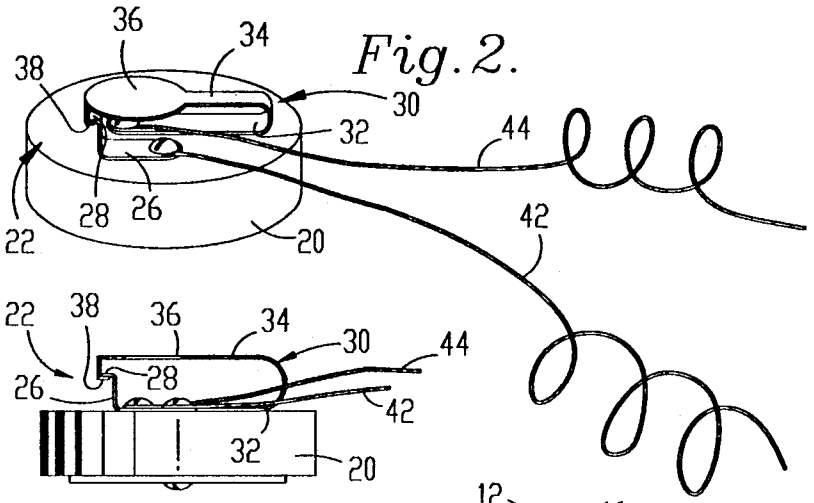
Fig. 2.
Fig. 3.
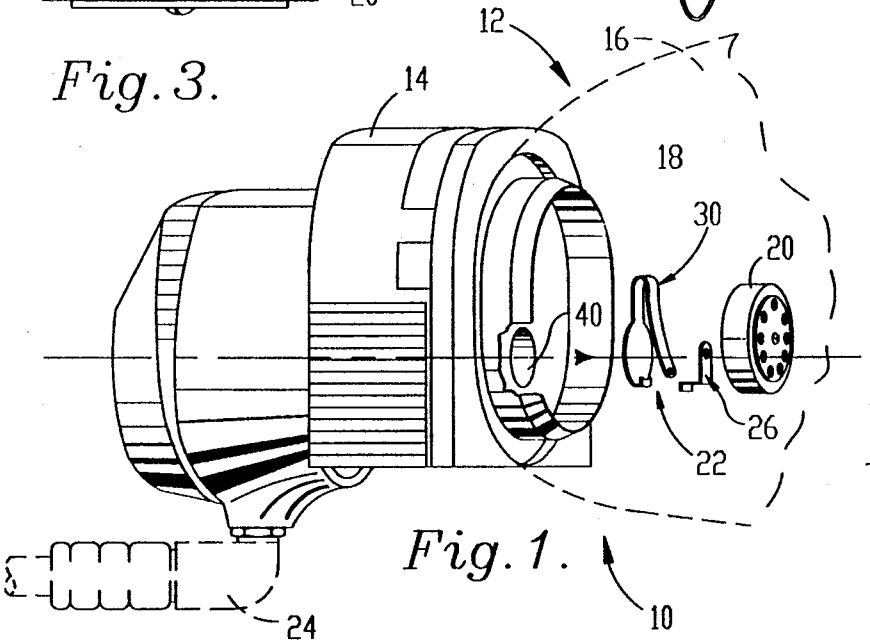
Fig. 1.

MICROPHONE SIGNAL ATTENUATING APPARATUS FOR OXYGEN MASKS

BACKGROUND OF THE INVENTION

1. Field of the Invention

The present invention is concerned with the field of breathing masks and in particular with aircraft flight crew oxygen masks.

2. Description of the Prior Art

Most aircraft flight crew oxygen masks include a demand breathing regulator and a microphone. To communicate with other crew members or with the control tower, for example, the wearer of a prior art mask activates the microphone which converts received sounds into audio signals for transmission. The sounds received by the microphone include not only the wearer's voice, lude not only the wearer's voice, but background noise as well. When the wearer is inhaling, the sound of gas flow through the mask's breathing regulator is often particularly loud and is transmitted as noise having a large component comparable in both frequency and intensity to the sounds made by a person speaking. When two or more members of a flight crew are wearing masks at the same time and one of the crew members is speaking, the noise generated during inhalation by the others can seriously interfere with hearing or understanding the voice transmission of the crew member who is speaking.

As can be appreciated, this can present a very serious situation because usually two or more crew members are not on oxygen unless a flight problem has developed. In such circumstances, clear communications are especially important, but are the very circumstances that present the greatest interference with communications. Electronic filtering or dampening cannot be used without also filtering the sounds of speech. Accordingly, the prior art points out the need for a microphone equipped breathing mask that does not interfere with communications.

SUMMARY OF THE INVENTION

The breathing mask of the present invention solves the prior art problems discussed above and provides a distinct advance in the state of the art. More particularly, the breathing mask hereof reduces the production of audio signals generated during inhalation by a wearer of the mask.

The preferred mask includes a mask body configured for placement on a wearer's face and having an internal chamber in communication with the wearer's breathing passages, a gas delivery assembly for delivering breathable gas to the chamber and for exhausting gas therefrom, a microphone coupled with the mask body, and noise attenuation structure for reducing the production of audio signals by the microphone generated during inhalation by the wearer. In various preferred forms, the noise attenuation structure includes components for electrically disabling the microphone during inhalation by the wearer, and in other forms includes a cover shiftable into a covering relationship with the microphone during wearer inhalation in order to reduce the sounds received by the microphone.

BRIEF DESCRIPTION OF THE DRAWINGS

FIG. 1 is a partial perspective view of the preferred breathing mask with portions cut away, with the mask contact portion shown in dashed lines, and with the microphone and flow switch shown separated for clarity;

FIG. 2 is a perspective view of the microphone and flow switch of FIG. 1 shown assembled;

FIG. 3 is a side elevational view of the microphone and flow switch of FIG. 2;

FIG. 4 is an electrical schematic representation of the microphone and flow switch of FIG. 2 showing the flow switch in the closed position;

FIG. 5 is an electrical schematic representation of the microphone and flow switch of FIG. 2 showing the flow switch in the open position;

DETAILED DESCRIPTION OF THE PREFERRED EMBODIMENT

Figures 6, 7, 8:
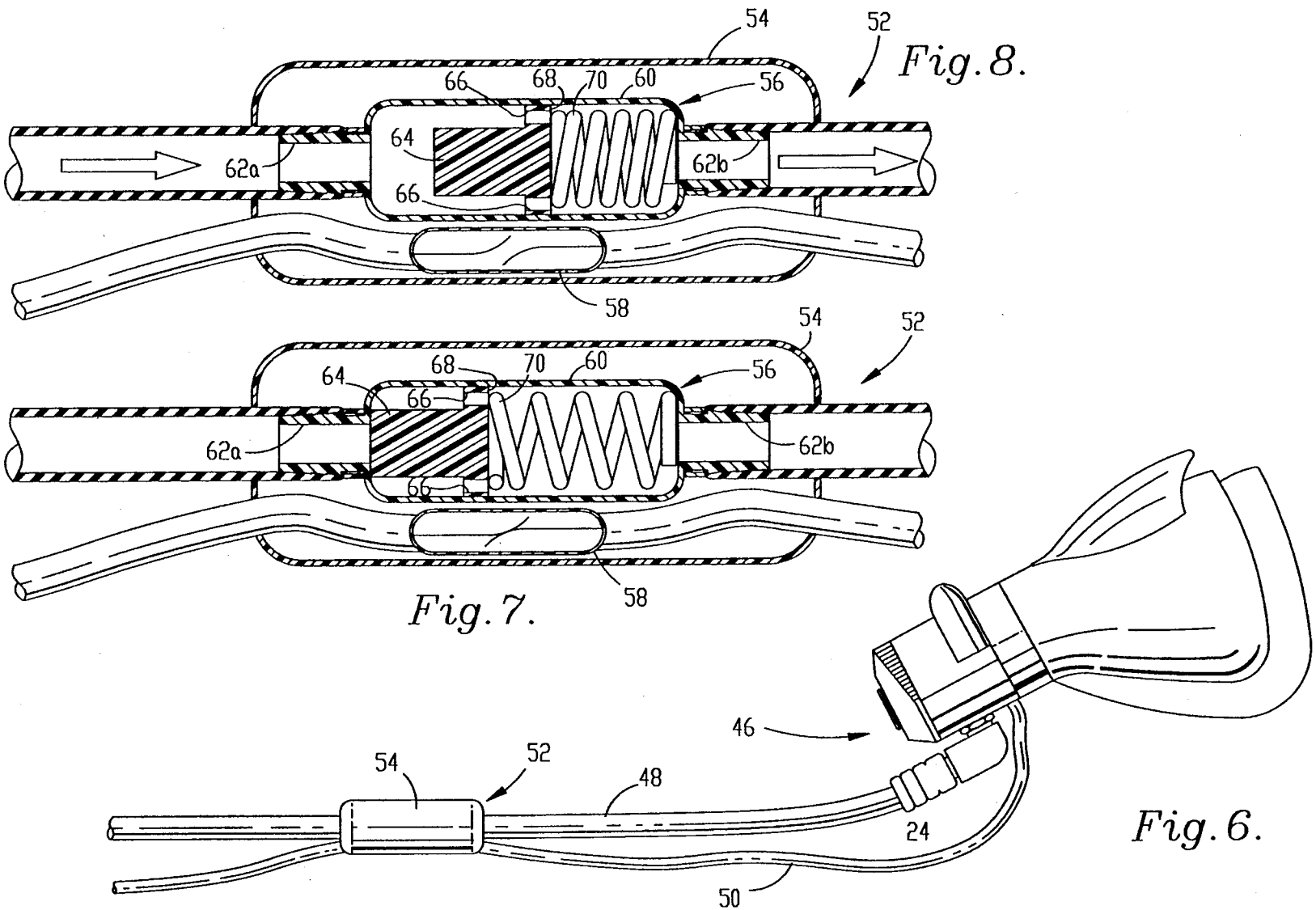
FIG. 6 is a side elevational view of the reed switch of the preferred breathing mask using a slidable magnetic body and magnetically responsive reed switch.
FIG. 7 is a sectional view of the magnetic body and switch of FIG. 6 shown in the non-inhalation position.
FIG. 8 is a sectional view of the magnetic body and switch of FIG. 6 shown in the inhalation position.

Turning now to the drawing figures and in particular FIGS. 1-5 illustrating the first preferred embodiment of the present invention, breathing mask 10 includes mask body 12 having housing portion 14 and face contact portion 16 with internal chamber 18, microphone 20, and flow switch 22. In the preferred embodiment, mask body 12 and microphone 20 are conventionally constructed as a crew oxygen mask for aircraft flight crews including gas delivery structure for delivering a breathable gas such as oxygen or an oxygen/air mixture to chamber 18 and for exhausting exhalation gases therefrom. The gas delivery structure includes a conventional regulator enclosed in housing portion 14 for receiving breathable gas under pressure by way of inlet coupling 24.

Flow switch 22 includes L-shaped, member 26 having fixed contact 28, and U-shaped, member 30 having base leg 32 and shiftable leg 34 which further includes circular body 36 and shiftable contact 38. As illustrated in FIGS. 2 and 3, members 26,30 are fastened to the rearward side of microphone 20 in the relationship illustrated with shiftable leg 34 biasing contacts 28,30,38 to the closed position.

Microphone 20 with flow switch 22 fastened thereto is received in breathable gas inlet opening 40 (FIG. 1) of mask body 12 with the forward face of microphone 20 exposed to chamber 18. Additionally, wires 42 and 44 are coupled electrically with contacts 28,38 respectively as part of the electrical circuit of microphone 20 as illustrated in FIGS. 4 and 5.

Contacts 28 and 38 are biased to the normally closed and in this position, microphone 20 is enabled to produce audio signals representative of sounds received thereby. When the wearer of mask 10 inhales, the mask regulator opens to deliver breathable gas from inlet coupling 24, to opening 40, and into chamber 18. When this occurs, the flow of the gas impinges on circular body 36 which shifts leg 34 against the bias thereof in order to open contacts 28 and 38. This action disables microphone 20 and attenuates the audio signals produced thereby to zero. In this way, the sounds of gas flow through microphone 20 and through the regulator, and the sounds of the regulator operation are not transmitted and thereby do not interfere with other mask wearers who are speaking.

FIGS. 6–17 illustrate other embodiments of the present invention which are similar to the embodiment illustrated in FIGS. 1–5 except for the differences described. Accordingly, the common components bear the same numerical designations.

FIGS. 6–8 illustrate mask 46 as a second embodiment of the present invention using a reed switch to disable the microphone. More particularly, this embodiment includes mask body 12, inlet coupling 24 connected with inlet hose 48, microphone cable 50 and switch assembly 52. Switch assembly 52 could be part of a combined switch and flow indicator if desired.

Switch assembly 52 includes housing 54 enclosing respective portions of hose 48 and cable 50 as illustrated, magnet assembly 56 and magnetically activated, normally closed reed switch 58 coupled in series with wires 42,44 leading from microphone 20. Reed switch 58 is coupled adjacent assembly 56 as illustrated. Magnet assembly 56 includes tubular coupling body 60 having respective end connectors 62*a* and 62*b* for connecting body 60 in line with hose 48, magnetic plunger 64 having a plurality of flow ports 66 defined in flange 68 thereof, and spring 70 biasing plunger 64 toward the closed position as illustrated in FIG. 7.

In operation, when the mask wearer inhales, the flow of gas as illustrated by the arrows in FIG. 8, shifts plunger 64 rightwardly against the bias of spring 70. This action allows breathable gas to flow through coupling body 60 and flow ports 66. This action also shifts plunger 64 to a position adjacent reed switch 58. In this position, the magnetic field from plunger 64 activates switch 58 to its open position thereby disabling microphone 20.

Figures 9, 15:
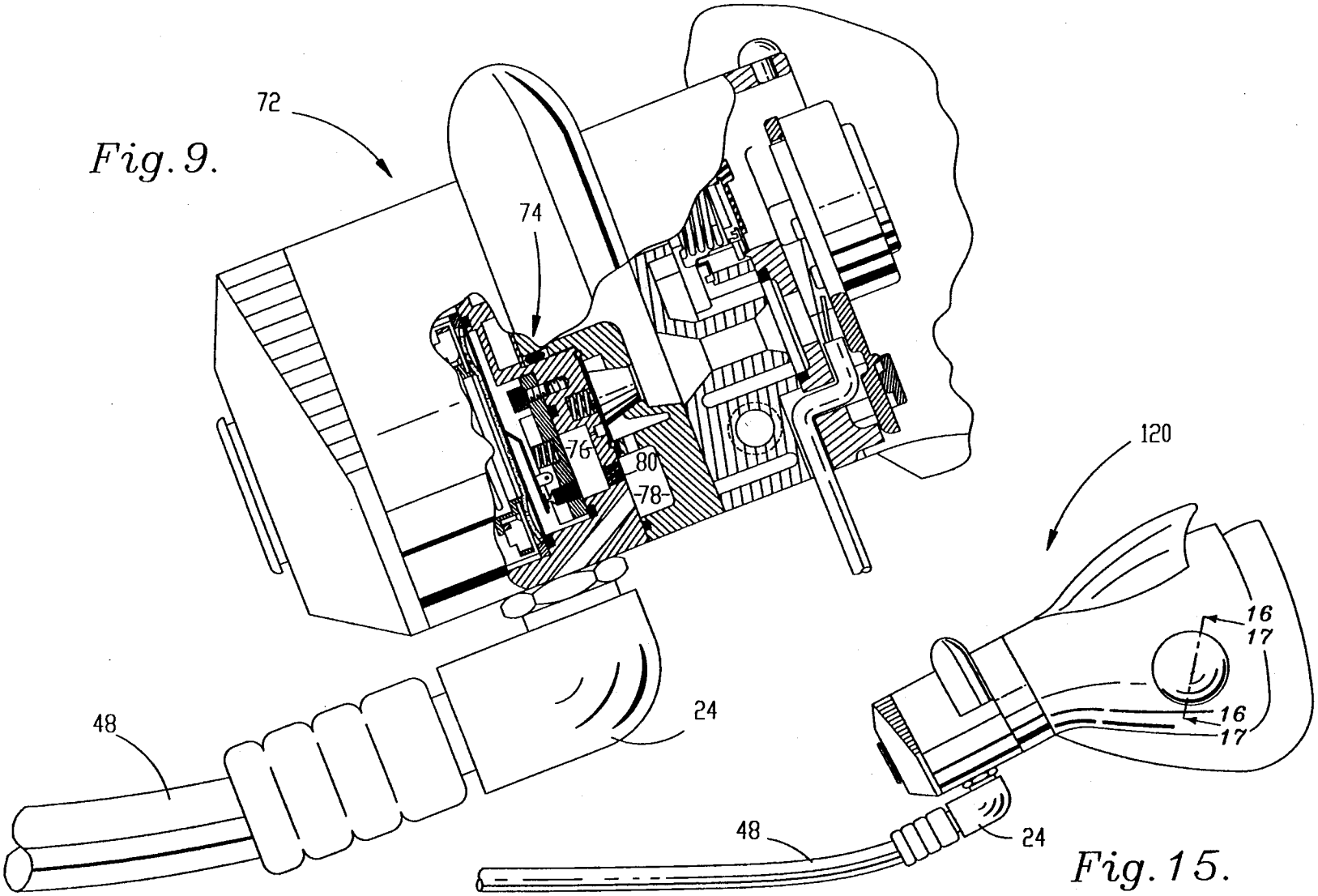
FIG. 9 is a side elevational view with portions cut away to present a partial sectional view of the differential pressure embodiment of the preferred breathing mask.
FIG. 15 is an elevational view of the microphone cover embodiment of the preferred breathing mask.
Figures 10, 11, 12, 16, 17:
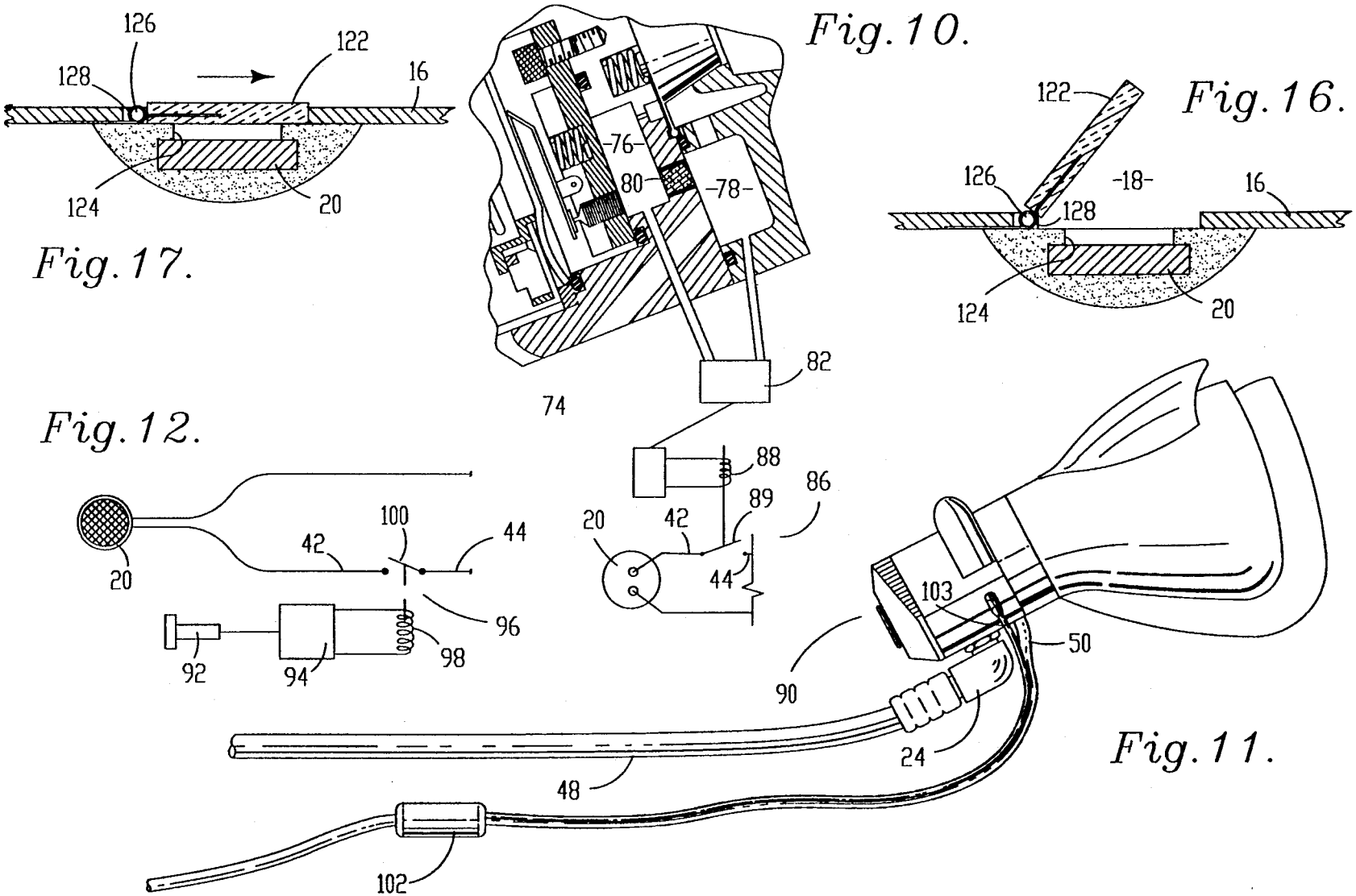
FIG. 10 is a combined partial sectional view and electrical schematic representation of the differential flow components of FIG. 9.
FIG. 11 is a side elevational view of the pressure transducer embodiment of the preferred breathing mask using a pressure transducer.
FIG. 12 is an electrical schematic representation of the embodiment of FIG. 11.
FIG. 16 is a partial sectional view taken along lines 16—16 of FIG. 15 showing the microphone cover in the open position.
FIG. 17 is a partial sectional view taken along lines 17—17 of FIG. 15 showing the microphone cover in the closed position.

FIGS. 9 and 10 illustrate mask 72 as the differential pressure embodiment of the present invention. Mask 72 includes regulator 74 having chambers 76 and 78 with orifice 80 therebetween, pressure transducer 82 pneumatically coupled with chambers 76,78, demodulator-/amplifier 84, and electromechanical relay 86 with coil 88 thereof electrically connected with demodulator-/amplifier 84 and with normally closed contact 89 thereof connected between wires 42,44.

In operation, inhalation by the mask wearer activates through. The flow path through regulator 74 includes chamber 76, orifice 80 and chamber 78. The provision of orifice 80 induces a differential pressure between chambers 76,78 as a result of the flow therethrough. This differential pressure is sensed by transducer 82 and in response, provides an output signal representative thereof to demodulator/amplifier 84 which in turn activates relay 86 when the differential pressure attains a predetermined level. Upon activation of relay 86, contact 89 opens and thereby disables microphone 20. FIGS. 11 and 12 illustrate mask 90 which is the fourth embodiment of the present invention using a pressure transducer. Mask 90 includes pressure transducer 92, demodulator/amplifier 94 electrically coupled with transducer 92, and electromechanical relay 96 having coil 98 electrically coupled with amplifier 94 and having normally closed contact 100 coupled between wires 42,44. Transducer 92 is preferably located within the regulator of mask 90 in the output opening thereof in order to sense pressure or partial vacuum induced when the mask wearer inhales. Amplifier 94 and relay 96 are enclosed within housing 102 and electrically connected by way of wire cable 103.

In operation, a pressure change induced by the onset of inhalation by the mask wearer is detected by transducer 92 and in response, produces an output signal representative thereof which is received by demodulator/amplifier 94. In turn, amplifier 94 activates relay 96 which opens contact 100 and disables microphone 20.

Figure 13:
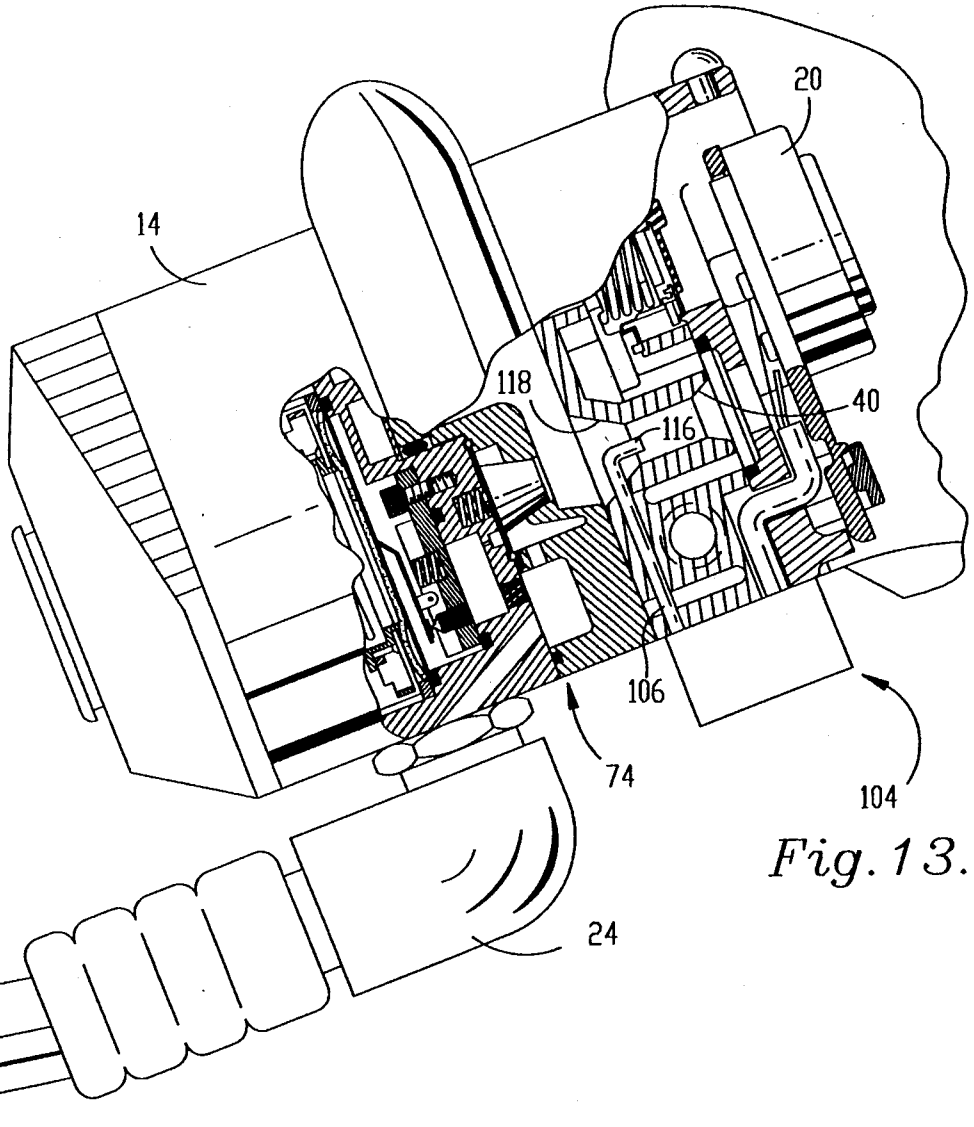
FIG. 13 is a side elevational view with portions cut away to present a partial sectional view of the pitot tube embodiment of the preferred breathing mask.
Figure 14:
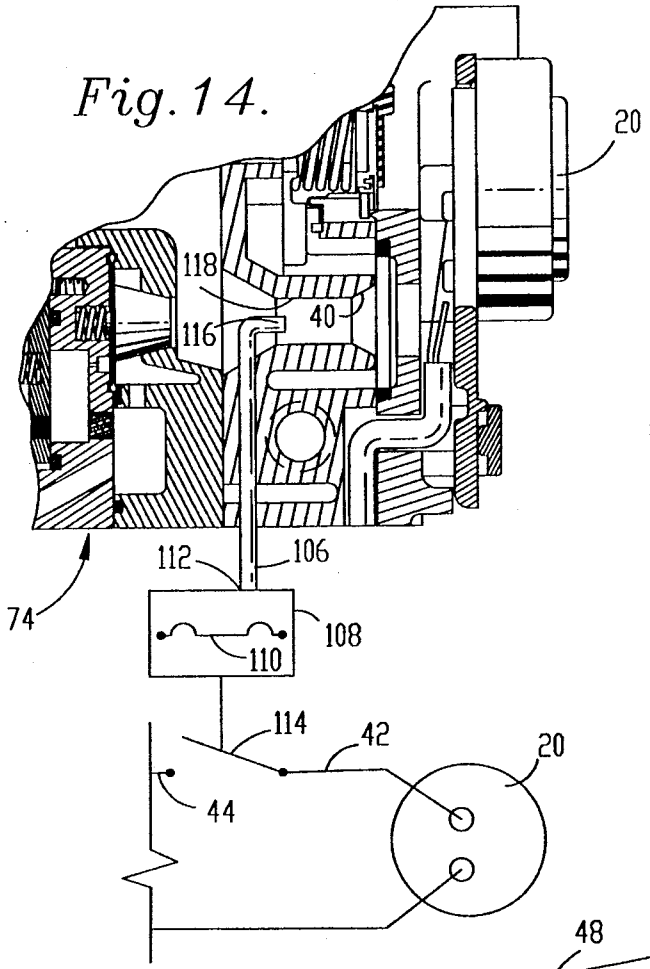
FIG. 14 is a combined partial sectional view and electrical schematic representation of the pitot tube components of FIG. 13.

FIGS. 13 and 14 illustrate mask 104 which is the pitot tube embodiment of the present invention. Mask 104 includes pitot tube 106 and vacuum switch 108 having diaphragm 110 pneumatically coupled with output end 112 of tube 106 and having switch 114 electrically connected between wires 42 and 44. Pitot tube 106 is placed so that sensor end 116 is oriented as illustrated in FIGS. 13 and 14 and located in outlet port 118 leading to opening 40.

In operation, inhalation by mask wearer induces gas flow through port 118. The gas flow through port 118 passes around pitot tube sensor end 116 and induces a partial vacuum within tube 106 which is sensed by diaphragm 110. In response, diaphragm 110 shifts and thereby opens switch 114 which disables microphone 20.

FIGS. 15, 16 and 17 illustrate mask 120 as the fifth embodiment of the present invention. This embodiment uses cover 122 composed of sound absorbing and insulating material to prevent or reduce sounds from entering microphone 20 during inhalation by wearer. Mask 120 presents microphone 20 located in recess 124 defined in the side of face contact portion 16. Mask 120 further includes hinge 126 hingedly coupling cover 122 adjacent recess 124 and spring 128 for biasing cover 122 to the open position as illustrated in FIG. 16.

In operation, inhalation by the wearer of mask 120 induces gas flow through chamber 18 as illustrated by the arrow in FIG. 17. This gas flow impinges upon cover 122 with sufficient force to overcome the bias of spring 128 in order to shift cover 122 from the open position of FIG. 16 to the closed position of FIG. 17. In this closed position, cover 122 is in a covering relationship relative to microphone 20 and reduces the level of the sounds received thereby. This in turn reduces the level of the audio signals produced by microphone 124 during inhalation by the wearer.

As those skilled in the art will appreciate, the present invention encompasses many variations in the preferred embodiments described herein. For example, the various switches can be configured as normally closed or normally opened depending upon a particular arrangement and could also be electronic swtiches such as transistors or other solid state devices. In addition, it may be desireable in some applications to attentuate or reduce the signal strength rather than to completely disable the microphone during inhalation.

Having thus described the preferred embodiments of the present invention the following is claimed as new and desired to be secured by Letters Patent:

We claim:

1. A breathing mask comprising:

a mask body configured for placement on a wearer's face and including structure defining an internal chamber in communication with the wearer's breathing passages;

means for delivering a breathable gas to said chamber and for exhausting gas therefrom;

a microphone coupled with said body for receiving sounds and for producing audio signals representative of said sounds, said microphone being subject to producing audio signals representative of sounds generated during inhalation by a wearer of the mask; and attenuation means for attenuating the production of said audio signals representative of said sounds generating during inhalation;

said attenuation means including cover means for blocking the reception of sounds by said microphone, said cover means being shiftable between an open position allowing reception of sounds by said microphone and a closed position blocking reception sounds and biasing means for biasing said cover means toward said open position, there being means for shifting said cover means to said closed position during delivery of breathable gas to said chamber thereby attenuating the production of said audio signals representative of said sounds generated during inhalation.

2. The mask as set forth in claim 1, said attentuation means including disabling means for disabling the production of microphone audio signals during said inhalation thereby attentuating the production of said audio signals representative of said sounds during inhalation.

3. The mask as set forth in claim 2, said disabling means including an air flow switch electrically coupled with said microphone and activatable in response to the flow of said breathable gas into said chamber for electrically disconnecting said microphone during activation of said switch.

4. The mask as set forth in claim 2, said delivering means including a gas delivery tube, said disabling means including a magnet slidably coupled within said tube and operable for shifting during gas delivery through said tube and a magnetically responsive switch coupled adjacent said tube and electrically coupled with said microphone for activation in response to shifting of said magnet and for electrically disconnecting said microphone during said activation.

5. The mask as set forth in claim 2, said disabling means including a differential flow transducer electrically coupled with said microphone for sensing delivery of said gas to said chamber and for electrically disconnecting said microphone during said delivery.

6. The mask as set forth in claim 2, said delivery means including a breathing regulator, said disabling means including a pressure transducer coupled with said regulator and electrically coupled with said microphone for sensing pressure changes during inhalation and for electrically disconnecting said microphone during said pressure changes.

7. The mask as set forth in claim 2, said disabling means including a pitot tube positioned within the flow of said gas delivered to said chamber during inhalation and operable for producing a pressure change during said flow, and including a pressure change responsive switch coupled with said pitot tube and electrically coupled with said microphone for sensing pressure change and for electrically disconnecting said microphone during said pressure change.

8. The mask as set forth in claim 1, said cover means including a cover hingedly coupled with said mask adjacent microphone and configured for shifting into a covering relationship relative to said microphone in said closed position, said biasing means including a spring coupled with said cover.

* * * * *